US005581984A

United States Patent [19]

Domke et al.

[11] Patent Number: 5,581,984

[45] Date of Patent: Dec. 10, 1996

[54] TUBULAR BAG MACHINE HAVING A DEVICE FOR KEEPING THE INSIDE OF A FLEXIBLE FILM TUBE FREE FROM DUST IN ITS SEALING REGION

[75] Inventors: Klaus Domke, Ditzingen; Herbert Stotkiewitz, Bietigheim-Bissingen; Anton Nieskens, Nederwert, all of Germany

[73] Assignee: Robert Bosch GmbH, Stuttgart, Germany

[21] Appl. No.: 537,919

[22] PCT Filed: Feb. 18, 1995

[86] PCT No.: PCT/DE95/00208

§ 371 Date: Nov. 1, 1995

§ 102(e) Date: Nov. 1, 1995

[87] PCT Pub. No.: WO95/23735

PCT Pub. Date: Sep. 8, 1995

[30] Foreign Application Priority Data

Mar. 1, 1994 [DE] Germany ..... 44 06 605.8

[51] Int. Cl.[6] ..... B65B 9/06

[52] U.S. Cl. ..... 53/552; 53/510; 53/167

[58] Field of Search ..... 53/550, 551, 552, 53/553, 554, 555, 510, 511, 167

[56] References Cited

U.S. PATENT DOCUMENTS

| | | | |
|---|---|---|---|
| 3,681,892 | 8/1972 | Satranski | 53/551 |
| 4,396,582 | 8/1983 | Kodera | 53/167 |
| 4,783,947 | 1/1988 | Posey et al. | 53/167 |
| 4,803,827 | 2/1989 | Posey et al. | 53/551 |
| 4,825,623 | 5/1989 | Ross | 53/551 |
| 5,014,493 | 5/1991 | West | 53/552 |

*Primary Examiner*—John Sipos
*Assistant Examiner*—Gene L. Kim
*Attorney, Agent, or Firm*—Edwin E. Greigg; Ronald E. Greigg

[57] ABSTRACT

A tubular bag machine has between a filling tube and a shaping tube at least two sealing elements, which divide an annular space, formed by the filling tube and shaping tube, into a feed channel and a suction-removal channel. The two channels are connected to a suction device with a filter by connecting lines. The design and arrangement of the sealing elements produce a closed circuit for the air or inert gas used for dust removal.

5 Claims, 1 Drawing Sheet

TUBULAR BAG MACHINE HAVING A DEVICE FOR KEEPING THE INSIDE OF A FLEXIBLE FILM TUBE FREE FROM DUST IN ITS SEALING REGION

PRIOR ART

The invention is based on a tubular bag machine having a device for keeping the inside of a flexible film tube free from dust in its sealing region. German Auslegeschrift 2,017,401 discloses such a tubular bag machine whose shaping tube has in the lower region air-outlet openings on the outer circumference. In the shaping tube there is formed by a filling tube arranged therein an annular space which is connected to a source of compressed air or inert gas. In operation of the tubular bag machine, compressed air or inert gas flows through the air-outlet openings, so that there forms, between the shaping tube and the region of the film of a bag pack later forming the transverse seam, a cushion of air or inert gas which prevents dust formed during the filling operation from adhering to this region of the film.

It is disadvantageous in the case of the known tubular bag machine that the compressed air or the inert gas flows at a relatively high speed over the lower edge of the shaping tube in the flexible tube, in the region of the filling-product outlet, and thus results in additional turbulence of the filling product or dust located in the flexible tube. This necessitates waiting a time until the dust has settled in the flexible tube before the region of film forming the transverse seam is transported further, which reduces the output of the known tubular bag machine.

Furthermore, German Auslegeschrift 1,511,636 discloses a congeneric tubular bag machine having a longitudinally displaceable shaping mandrel for delivering the filling product close to the end of the tubular bag and having a suction line for venting the annular space between the shaping mandrel and the filling tube. It is disadvantageous in the case of this tubular bag machine that the displaceable shaping mandrel entails considerable mechanical complexity and, with the use of inert gas instead of air, part of the inert gas is lost from the tubular bag machine.

It is therefore desirable for it to be possible not only to keep the region of film forming the transverse seam of the bag pack reliably free from dust but also to remove the dust by suction. Furthermore, if inert gas is used, as little inert gas as possible should be lost.

ADVANTAGES OF THE INVENTION

The tubular bag machine according to the invention, having a device for keeping the inside of a flexible film tube free from dust in its sealing region, has in comparison, the advantage that air or inert gas is circulated by means of a suction device with a filter and can be fed specifically to the sealing region. This ensures on the one hand that the region of film of the bag pack forming the later transverse seam is reliably kept free from dust and on the other hand that, if inert gas is used, it is to a great extent returned or reused.

Further advantages and advantageous developments of the invention emerge from the description hereinafter.

A simple separation of the annular space between the shaping tube and the filling tube into two elongate regions is possible by means of two sealing elements.

Particularly good conduction of the air stream or gas stream, and a low discharge of filling product are obtained by virtue of an overflow region free from sealing elements in the region of the delivery end of the filling tube.

BRIEF DESCRIPTION DRAWING

An exemplary embodiment of the invention is represented in the drawing and is explained in more detail in the following description. FIG. 1 shows a front view of a tubular bag machine having a device for keeping the inside of a flexible film tube free from dust in its sealing region in a simplified form; and FIG. 2 shows a cross section of the tubular bag machine according to FIG. 1 in the plane II—II of FIG. 1.

DETAILED DESCRIPTION OF THE EXEMPLARY EMBODIMENT

Figure 1:
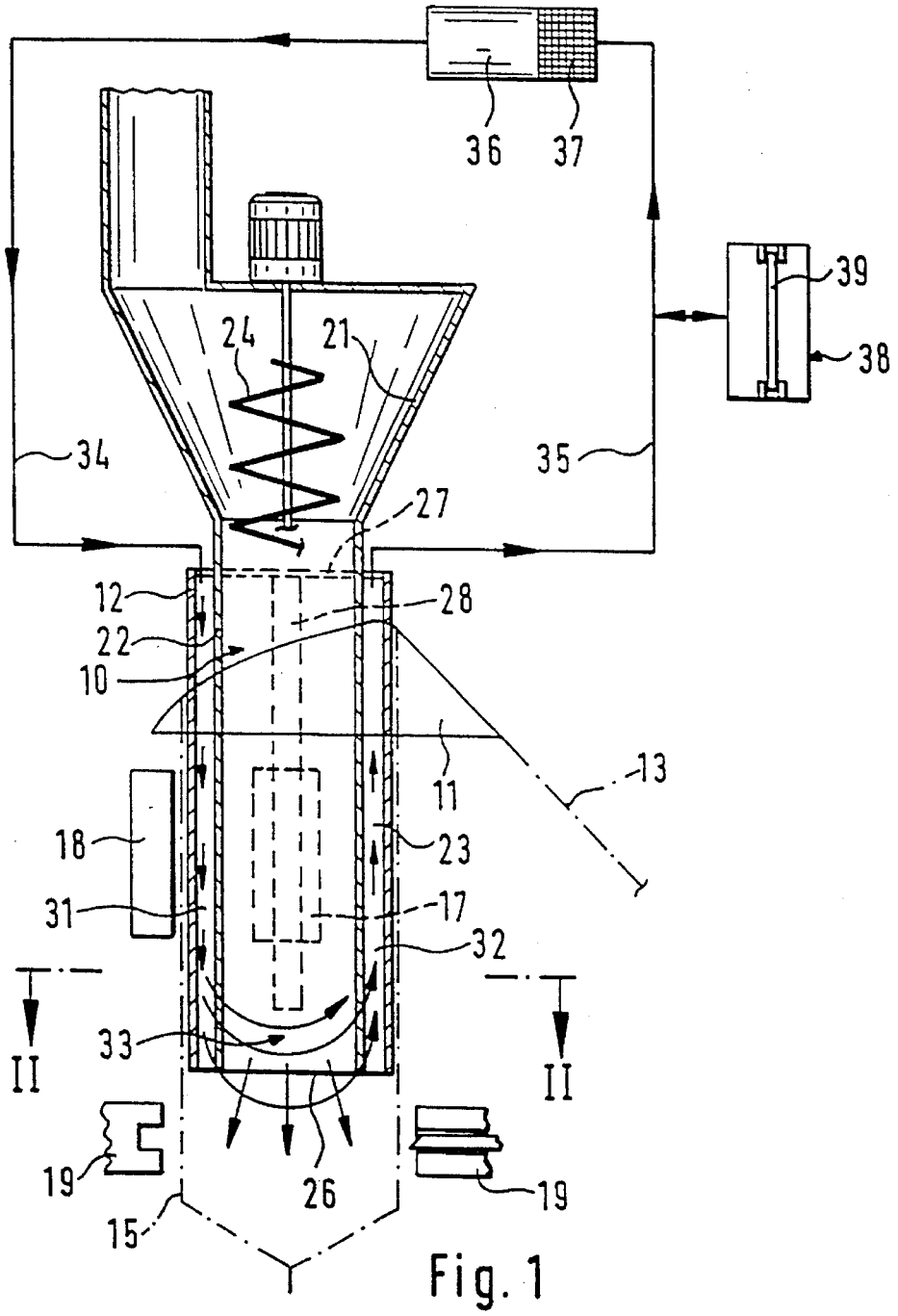
Figure 2:
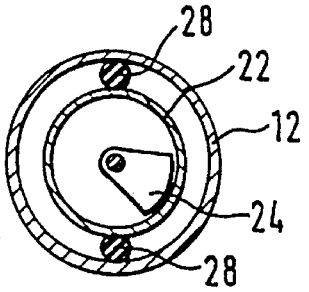

A tubular bag machine 10 known per se has a shaping shoulder 11 and a shaping tube 12, with the aid of which a flexible tube 15 is shaped from a packaging material web 13 of sealable material. Arranged on the outside of the shaping tube 12 is at least one transporting device for the flexible tube 15, for example in the form of a pneumatically controlled transporting belt 17. Furthermore, a longitudinal-seam-sealing device 18 is provided in the region of the shaping tube 12, and a transverse-seam-sealing and separating device 19 for the flexible tube 15 is provided underneath the shaping tube 12. Above the shaping tube 12 there is a filling-product funnel 21 which opens out into a filling tube 22 which is arranged coaxially in the shaping tube 12 and together with the latter forms an annular space 23. The filling-product funnel 21 is assigned a metering screw 24, which continues in the filling tube 22, only the upper part of the latter being represented in FIG. 1 for the sake of simplicity. The delivery end 26 of the filling tube 22 terminates flush with the end of the shaping tube 12. At the upper end of the shaping tube 12, the filling tube 22 is sealed off from the shaping tube 12 by means of an annular disc 27.

Arranged diametrically between the annular disc 27 and the delivery end 26 in the annular space 23 are two rectilinear sealing elements 28. These respectively comprise an elastically deformable rubber hose or a rubber strand of circular cross section, but may also for example take the form of sheet-metal strips. The sealing elements 28 divide the annular space 23 into two elongate channels 31, 32, of which the first is referred to as feed channel 31, and the latter is referred to as suction-removal channel 32. The sealing elements 28, the upper ends of which terminate in a sealed manner with the annular disc 27, reach at their lower ends only as far as above the delivery end 26, so that there is produced in the annular space 23 above the delivery end 26 an overflow region 33 free from sealing elements. What is essential is that the sealing elements 28 terminate the channels 31, 32 in a sealed manner with respect to each other.

Arranged in the annular disc 27 are two lines 34, 35, of which one 34 is connected to the feed channel 31 and the other 35 is connected to the suction-removal channel 32. The lines 34, 35 lead to a suction device 36 with filter 37.

The apparatus described above functions as follows: a flexible tube 15 is continuously or intermittently shaped by the tubular bag machine 10 and filled by means of the metering screw 24 through the filling tube 22 at time intervals with a metered amount of filling product in each case. The dust produced during the falling of the filling product from the delivery end 26 of the filling tube 22 into the flexible tube 15 is removed from the flexible tube 15 by the suction device 36 through the suction-removal channel 32, so that no dust can settle on the region of the packaging-material web 13 forming the later transverse seam of the bag pack. The dust/air mixture is in this case cleaned by the filter 37 of the suction device 36. The air with dust removed is subsequently fed again to the feed channel 31, so that a closed circuit is accomplished.

If use is made of inert gas, which is introduced for example by means of a device not shown into the filling-product funnel 21, it is ensured by the closed circuit that, with a correspondingly designed suction device 36, no inert gas escapes from the tubular bag machine 10, in particular if the filling-product funnel 21 is also sealed off from the outside. Since the sealing elements 28 do not reach as far as the delivery end 26, the greater part of the air or of the gas flows from the feed channel 31 via the overflow region 33 directly into the suction-removal channel 32 again, the raised dust in the flexible tube 15 being entrained. The conduction of the air stream or gas stream via the overflow region 33 achieves the effect that the stream of filling product is not used for taking the dust along. As a result, there is no, or only very low, filling product discharge, which increases the efficiency of the tubular bag machine 10 and avoids losses of filling product.

The foregoing relates to preferred exemplary embodiments of the invention, it being understood that other variants and embodiments thereof are possible within the spirit and scope of the invention, the latter being defined by the appended claims.

We claim:

1. A tubular bag machine (10) having a device for keeping the inside of a flexible film tube (15) free from dust in a sealing region, having a shaping tube inside said flexible film tube (12) for shaping the flexible tube (15) from a packaging-material web (13) of sealable material, a filling tube (22), which is arranged within the shaping tube (12), said filling tube forms together with the shaping tube (12) an annular space (23) and wherein a dust-generated filling product is introduced into one end of the flexible tube through the filling tube, a transverse-seam-sealing device (19) spaced from a delivery end (26) of the shaping tube (12) and filling tube (22), wherein the annular space (23) includes an opening into said flexible tube between the filling tube (22) and the shaping tube (12) is subdivided longitudinally into at least two channels (31, 32) which are sealed off with respect to each other, and wherein the two channels (31, 32) are connected to each other outside the shaping tube (12) and filling tube (22) by means of a suction device (36) with a filter (37) in the form of a closed circuit.

2. The tubular bag machine as claimed in claim 1, wherein the annular space (23) is divided by sealing element (28) extending parallel to a longitudinal axis of the shaping tube (12) and filling tube (22).

3. The tubular bag machine as claimed in claim 2, wherein a length of the sealing element (28) is less than a length of the region of overlap between the filling tube (22) and the shaping tube (12), and wherein an overflow region (33) free from any sealing elements is formed in a region of the delivery end (26).

4. (Amended) The tubular bag machine as claimed in claim 2, wherein the cross section of the sealing elements (28) is circular.

5. The tubular bag machine as claimed in claim 3, wherein the cross section of the sealing elements (28) is circular.

* * * * *